United States Patent [19]

Haslbeck

[11] Patent Number: 4,755,040

[45] Date of Patent: Jul. 5, 1988

[54] SWIM GOGGLES

[75] Inventor: Joseph Haslbeck, West Vancouver, Canada

[73] Assignee: Sharp Plastics Mfg. Ltd., Delta, Canada

[21] Appl. No.: 889,783

[22] Filed: Jul. 28, 1986

[51] Int. Cl.[4] ..... G02C 1/00; A61F 9/02

[52] U.S. Cl. ..... 351/43; 351/62; 2/428

[58] Field of Search ..... 351/43, 62, 158; 2/428, 2/426, 440

[56] References Cited

U.S. PATENT DOCUMENTS

| | | | |
|---|---|---|---|
| 1,741,427 | 12/1929 | Meyrowitz . | |
| 1,850,538 | 3/1932 | Dickson . | |
| 1,936,746 | 11/1933 | Baker | 2/14 |
| 2,024,322 | 12/1935 | Wittig . | |
| 2,393,533 | 1/1946 | Heinz | 2/14 |
| 2,918,676 | 12/1959 | Matheson | 2/14 |
| 2,928,097 | 3/1960 | Neufeld | 2/14 |
| 3,259,909 | 7/1966 | Wood | 2/440 |
| 3,789,428 | 2/1974 | Martin | 2/14 |
| 4,286,340 | 9/1981 | Lathrop | 2/430 |
| 4,405,212 | 9/1983 | Cooper | 351/43 |

*Primary Examiner*—John K. Corbin
*Assistant Examiner*—P. M. Dzierzynski
*Attorney, Agent, or Firm*—Bull, Housser & Tupper

[57] ABSTRACT

Swim goggles have a pair of eye pieces, each eye piece having a lens with an essentially rigid peripheral frame. Each eye piece has a seal assembly which includes a seal holder and a seal gasket. The seal holder is secured to the frame and has a pair of spaced flanges extending in a direction generally away from the respective lens. Space between the flanges of the seal holder provides a groove extending around the eye piece and the seal holder is resiliently deformable but relatively stiff. The seal gasket is fitted within the space between the flanges and has an outer face standing clear of the flanges to contact the wearer's face. The seal gasket is resiliently deformable and softer than the seal holder to provide a secure but comfortable seal with the wearer's face. Selection of the relative resiliences of the seal holder and seal gasket permits accommodation to a wide variety of faces and extends use of the goggles. A swim mask with single lens provided with a seal assembly as above is an alternative.

20 Claims, 1 Drawing Sheet

SWIM GOGGLES

BACKGROUND OF THE INVENTION

1. Field of the Invention

The invention relates to goggles for eye protection which are particularly adapted for, but not limited to, swimming.

2. Prior Art

Many varieties of swim goggles have been available to accommodate the variations between wearer's faces. Swim goggles should provide a good seal against water penetration, as well as being comfortable for extended wear. It is known to provide a resilient seal or gasket made from an expanded elastomer or rubber compound which extends from the rigid frame of the goggles to contact the face. The seal is adapted to engage recesses and bulges of the face, so as to provide a water-tight but comfortable fit. If the seal is excessively soft, it usually deteriorates quickly in the chlorinated water commonly used in swimming pools. Soft seal gaskets can deform under a relatively low force which seems to be necessary for comfort when fitted directly against the face, and can deform in a direction normal to the face to accommodate curvature of the face. However, excessively soft seals which project too far from a rigid base can deform excessively in a direction parallel to the face i.e., fold over, which can reduce effectiveness of the seal and permit leakage.

Harder types of seals require a greater force to deform them to fit the face, and correspondingly can become uncomfortable after a short time. The more rigid seals tend to resist deterioration better than the softer seals, and do not deform excessively but, in general, cannot accommodate such a wide variety of curvatures of the face. In general, goggles for long distance training swimming are softer for greater comfort than goggles used for racing. Racing goggles must be sufficiently stiff to resist the shock forces of a racing dive, and thus comfort is often sacrificed because such goggles are usually worn for shorter periods.

U.S. Pat. Nos. 1,850,538 (Dickson) and 1,741,427 (Meyrowitz) disclose goggles having seals of the resilient cushion type, but these goggles do not appear to be suitable for swimming. The seals of these goggles can be easily replaced when worn, but the structure for attaching the seals to the frame of the goggles is such that the goggle seals can accidentally be dislodged from the goggles, which could cause leakage, become uncomfortable and even distort vision through the goggles. U.S. Pat. No. 2,393,533 (Heinz) discloses a resilient seal for swimming goggles which is a hollow tube extending around the rim of the eye pieces. The tube is formed from a relatively stiff elastomer compound, but its cross-section and thin walls permits it to deform to accommodate variations in the face.

To the inventor's knowledge, none of the prior art goggles provide a seal which combines the comfort of the resilient, soft, low density elastomeric cushion foam with the stiffness and accuracy of location arising from use of the stiffer, higher density elastomeric materials. To the inventor's knowledge, none of the prior art goggles provides a seal which can accommodate the wide variability of the human face, be comfortable, resist the shock loads of a racing dive, and water resistant and also permit easy replacement of a worn soft seal.

SUMMARY OF THE INVENTION

The invention provides a seal for goggles which reduces the difficulties and disadvantages of the prior art by providing a seal assembly of composite materials. The seal assembly includes a combination of a relatively stiff material which provides a degree of resilience to accommodate the larger curvatures of the face, without excessive distortion, and a softer material which contacts the face to provide comfort and a yielding seal to accommodate smaller variations in curvature of the face. In effect, there is a gradual change in stiffness from the essentially rigid peripheral frame of the lens, through an intermediate semi-resilient material to the softness of the cushion seal which actually contacts the face. By correct selection of seal materials, the invention provides swim goggles which can be used with a soft seal for training, and a harder seal can be substituted for racing.

Swim goggles according to the invention have a pair of eye pieces, with each eye piece having a lens with an essentially rigid peripheral frame. A nose strap and the head strap interconnect the eye pieces at inner and outer end portions respectively of the frames, as is common practice. Each eye piece has a seal assembly which includes a seal holder and a seal gasket. The seal holder is secured to the respective frame and has a pair of spaced flanges extending in a direction generally away from the respective lens. Space between the flanges provides a groove extending around the eye piece. The seal holder is resiliently deformable but relatively stiff. The seal gasket is fitted within the groove between the flanges and has an outer face standing clear of the flanges and is adapted to contact the wearer's face. The seal holder is resiliently deformable under normal wearing forces when compared with the rigid frame, but sufficiently stiff to compress and retain the seal gasket within the groove. The seal gasket is resiliently deformable and softer than the seal holder so that relative stiffness of the seal gasket, the seal holder and the frame increases in a direction away from the wearer's face. As to provide a secure but comfortable seal with the wearer's face. In one embodiment the frame of each eye piece has engaging means to cooperate with the seal holder, the engaging means being a L-sectioned lug extending around the frame. The seal holder has an inner portion which has a L-sectioned recess complementary to the L-sectioned lug and adapted to receive the L-sectioned lug. In an unrestrained condition, the groove has a re-entrant cross-section with an inner width between the flanges greater than an outer width between the flanges, so as to grip the seal gasket therebetween.

A single lens face mask with an essentially rigid peripheral frame can be fitted with a seal assembly according to the invention to provide a face mask which is more appropriate for Scuba diving.

A detailed disclosure following, related to drawings, describes a preferred embodiment of the invention which is capable of expression in structure other than that particularly described and illustrated.

DETAILED DISCLOSURE

FIGS. 1 and 2

Figures 1, 2, 3, 4, 5:
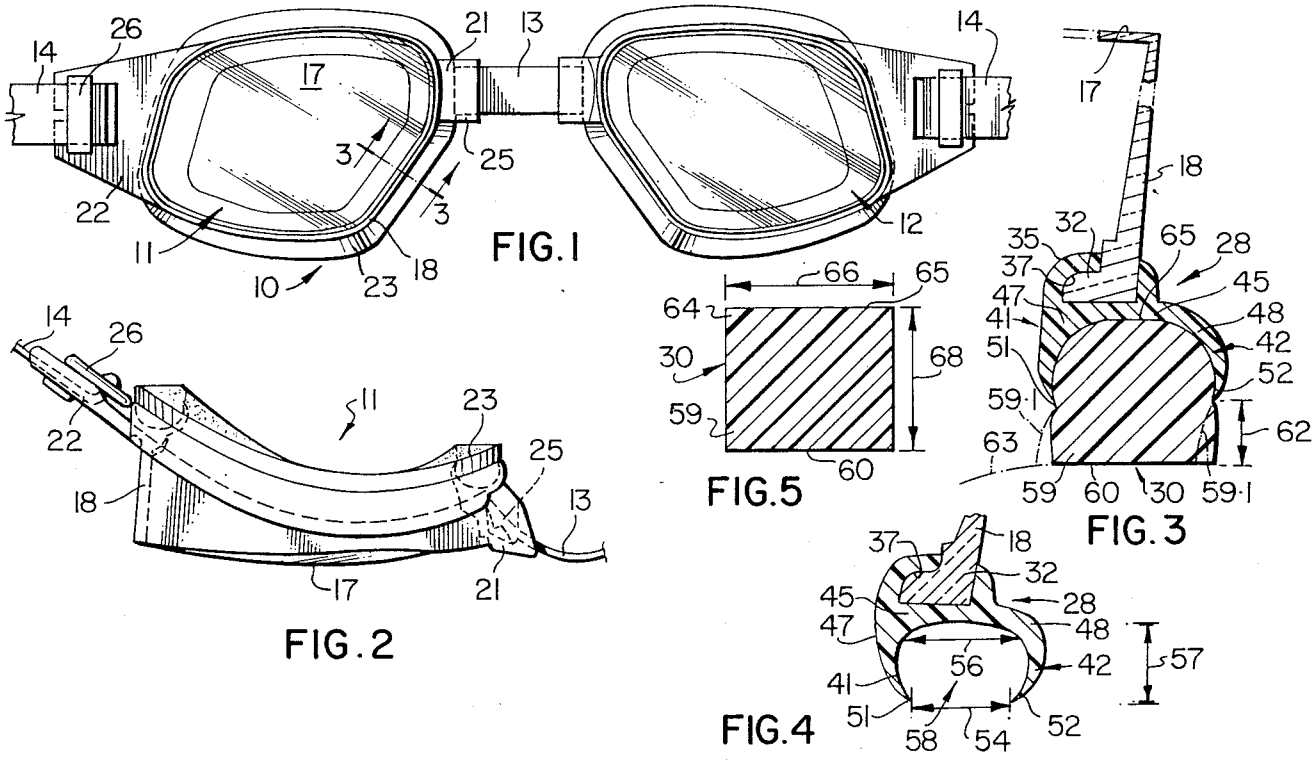
FIG. 1 is a simplified, fragmented front view of a pair of swim goggles fitted with a seal assembly according to the invention.
FIG. 2 is a fragmented top plan of one eye piece portion of the goggles of FIG. 1.
FIG. 3 is a simplified framented section on line 3-3 of FIG. 1, showing a seal assembly with a seal holder and seal gasket according to the invention.
FIG. 4 is a simplified fragmented section, generally as would be seen on line 3—3 of FIG. 1, with the seal gasket removed from the seal holder so that the seal holder is in an unrestrained condition.
FIG. 5 is a simplified cross-section through a seal gasket of the invention in an unrestrained condition.

Swim goggles 10 according to the invention have first and second eye pieces 11 and 12, a nose strap 13 and a head strap 14. The nose strap interconnects adjacent inner end portions of the frames as shown, and bridges the nose, not shown, of a wearer, and the head strap 14 interconnects outer end portions of the frames and passes around the back of the head as is common practice. The eye piece 11 has a transparent lens 17 and an essentially rigid peripheral frame 18. Preferably, for manufacturing simplicity and for improved peripheral vision, the eyepiece and frame are integral and thus the frame is also transparent. The frame 18 has inner and outer portions 21 and 22 which provide releasable anchor means 25 and 26 respectively for the nose strap and head strap 13 and 14 respectively. The eye piece 11 has a seal assembly 23 according to the invention provided on a side of the frame 18 remote from the lens so as to contact the wearer's face, not shown.

The eye piece 12 has structure generally similar to the eye piece 11, and is a mirror image thereof and is not described in detail.

FIGS. 3 through 5

The seal assembly 23 includes a seal holder 28 and a seal gasket 30. The frame 18 has a L-sectioned lug 32 extending around the frame as best seen in FIG. 3. The L-sectioned lug faces inwardly around the peripheral frame and the seal holder 28 has an inner portion 35 which has an L-sectioned recess 37 which is complementary to the L-sectioned lug 32 and is adapted to receive the L-sectioned lug. Thus, the L-sectioned lug of the frame serves as an engaging means to cooperate with the seal holder and, if desired, the frame and seal holder can be integrally molded together. The lug and seal holder can have other complementary shapes so that the inner portion of the seal holder is adapted to cooperate with the engaging means of the frame.

The seal holder 28 has an outer portion having inner and outer flanges 41 and 42, and an intermediate portion 45 disposed between the inner and outer portions of the flange. The flanges 41 and 42 extend in a direction generally away from the respective lens 17 and have respective flange roots 47 and 48 adjacent the intermediate portion, and flange tips 51 and 52 at outer extremities of the flanges. As best seen in FIG. 4, in the unrestrained condition, an outer width 54 between the flange tips is less than an inner width 56 between the flange roots. It can be seen that space between the flanges provides a groove 58 extending around the eye piece, the groove having a depth 57. Thus, the groove 58 has a re-entrant crosssection with the inner width 56 between the flanges being greater than the outer width 54 between the flanges.

The seal gasket 30 has an inner portion 64 fitted in the groove 58 between the flanges and has an outer portion 59 having a relatively flat outer face 60 standing clear of the flanges by a distance 62. The distance 62 is sufficient to permit only limited lateral deformation of the outer portion 59 of the seal gasket i.e., parallel to the face to accommodate contours of the wearer's face. Slight lateral deformation of the outer portion 59 of the seal gasket 30 is shown in broken outline at 59.1. When the seal is laterally deformed, an effective watertight seal with the face is not lost because the outer face 60 remains relatively flat and in contact with the wearer's face 63, shown in broken outline. The seal gasket is resiliently deformable and fabricated from an expanded or foamed elastomer as will be described. It is softer than the seal holder so as to provide a secure but comfortable seal with the wearer's face. It can be seen that relative stiffness of the three components of the goggles increases in a direction away from the face, i.e., the softest components are closest to the face.

As seen in FIG. 5, the seal gasket 30 is shown in the unrestrained condition and the inner portion 64 has a width 66 which is greater than the inner width 56 of the groove 58 in the unrestrained condition as seen in FIG. 4. The seal gasket can be die cut from a flat sheet and is generally rectangular in cross-section when unrestrained. An inner face 65 of the gasket can be provided with a "low tack" contact adhesive which can releasably bond to the portion 45 of the seal holder so as to augment retention of the seal gasket in the seal holder. The seal gasket can be removed from the holder with a negligible deposit of the "low tack" adhesive remaining on the seal holder.

Preferably, the seal gasket 30 has a depth 68, see FIG. 5, which is approximately twice the depth 57 of the groove 58. In this way, approximately half the depth of the seal is gripped and retained by the flanges, and the remaining half stands proud of the flanges and can accommodate contours of the face, while simultaneously providing a soft uncomfortable seal. Preferably, the flanges are curved inwardly towards each other in the unrestrained condition as seen in FIG. 4, so as to grip the seal gasket therebetween at a location on the seal gasket intermediate of inner and outer faces of the seal gasket.

Material Considerations

The effectiveness and comfort of the seal of the present invention is dependent on the correct selection of materials for the two components of the seal assembly. The seal holder 28 is molded from thermoplastic rubber compounds which are resilient and yet relatively stiff. Suitable materials are manufactured by Shell Chemical Inc., under the trade mark KRATON D and KRATON G, and particular specifications of suitable compounds are as follows.

Hardness [Shore A(D-2240)]: 35 through 95.
Tensile strength [D-412] PSI: 500 through 2500
300% Modulus, PSI: 300 to 1400
Elongation %: 600 to 700
Tear resistance [die C] PLI (D-624): 95 through 550
Yerzly resilience [3% (D-945)]: 71 through 75

The typical properties outlined above for the KRATON G 2705, G-7705, G-7720, G7820 and G-7827 are summarised for typical properties at 74 degrees Farenheit (23 degrees Centigrade). Such compounds have excellent ozone resistance which is essential for use in chlorinated water as is well known in the trade.

The seal gasket 30 can be manufactured by cutting from flat sheets of high density cellular polyurethane, sold under the trade mark PORON, as manufactured by the Rogers Corporation of East Woodstock, Conn.

Other suitable compounds include RUBBERTEX, registered trade mark of Rubbertex Corporation of Virginia, U.S.A., and ENSOLITE, a registered trade mark of Uniroyal Plastics Co., Inc., of Indiana U.S.A. A "low tack" contact adhesive can be applied to one side of the sheet to improve retention of the seal gasket within the seal holder.

Typical properties of suitable seal gasket material are summarised below.

Compression deflection (PSI): 2–10
Hardness: Shore 00 Durometer 10–50 to Shore A7–20
Resilience (Bashore): - 8 -
% Rebound Average: 40–60

Tensile strength and elongation are not very important properties for the seal gasket as the seal gasket is supported by the seal holder. This permits use of a relatively soft gasket material when compared with prior art gaskets. Materials are selected also for their aging properties, and ozone and chlorination resistance as well as tendency to resist adhering to the face.

OPERATION

The goggles are used in a normal manner, by adjusting the spacing between the eye pieces by careful adjustment of the nose strap. Similarly, the force of the goggles against the face is adjusted by the head strap 14.

For racing use, goggles are usually worn for only a short time, and the seal must withstand the forces of a racing dive. Thus a relatively stiff seal gasket, and correspondingly stiffer seal holder are preferred. For training purposes, where forces are lower, and the goggles are worn usually for a longer time, comfort is preferred and correspondingly softer materials are selected for the seal holder and seal gasket. Alternatively the same goggles and seal holder can be used for both trainging and racing, and only the seal gasket need be changed for the different activities. In general, the seal gasket will deteriorate far faster than the seal holder, and it is relatively easy to replace a worn or deteriorated seal gasket with a new one.

ALTERNATIVES AND EQUIVALENTS

A face mask with a single lens can be fitted with a seal assembly according to the invention and obtain the benefits of comfort, accuracy of sealing fit and easy replacement or material substitution of the seal gasket. This type of mask is particularly appropriate for Scuba diving, and clearly requires only a head strap interconnecting opposite sides of the mask, the nose strap being eliminated.

I claim:

1. Swim goggles, comprising:

(a) an eyepiece having a lens with an essentially rigid peripheral frame including end portions, the peripheral frame being made of a first material, (b) a strap interconnecting the end portions of the frame, (c) the eyepiece having a seal assembly which includes a seal holder and a seal gasket being made of a second material and a third material, respectively, the seal holder being secured to the frame and having a pair of spaced flanges extending in a direction generally away from the eyepiece, space between the flanges providing a groove extending around the eyepiece, the seal gasket being fitted within the groove between the flanges and having an outer face standing clear of the flanges and being adapted to contact the wearer's face, the seal holder being resiliently deformable under normal wearing forces when compared with the rigid frame, but sufficiently stiff to compress and retain the seal gasket within the groove, the seal gasket being resiliently deformable and softer than the seal holder, and the seal holder being more resilient than the peripheral frame so that stiffness of the second material relative to the third material, and the stiffness of the first material relative to the second material increases continually outwardly in a successive fashion in a direction away from the wearer's face to provide a secure but comfortable seal with the wearer's face.

2. Swim goggles as claimed in claim 1 in which:

(a) the frame has engaging means to cooperate with the seal holder, (b) the seal holder has an inner portion adapted to cooperate with the engaging means of the frame, an outer portion having the two flanges, and an intermediate portion disposed between the inner and outer portions thereof.

3. Swim goggles as claimed in claim 2 in which:

(a) the engaging means of the frame has a L-sectioned lug extending around the frame, (b) the inner portion of the seal holder has a L-sectioned recess complementary to the L-sectioned lug and adapted to receive the L-sectioned lug.

4. Swim goggles as claimed in claim 1 in which:

(a) the frame and seal holder are integrally molded together.

5. Swim goggles as claimed in claim 1 in which:

(a) in an unrestrained condition, the groove has a re-entrant cross-section with an inner width between the flanges greater than an outer width between the flanges.

6. Swim goggles as claimed in claim 1 in which:

(a) the seal holder has an inner portion cooperating with the frame, an outer portion having the two flanges, and an intermediate portion disposed between the inner and outer portions thereof, (b) the flanges having flange roots adjacent the intermediate portion and flange tips at outer extremities of the flanges, width between the flange tips being less than width between the flange roots in the unrestrained condition, so as to provide a groove with a re-entrant cross-section to grip the flange gasket.

7. Swim goggles as claimed in claim 1 in which the seal gasket has:

(a) an inner portion having a width slightly greater than width of the groove between the flanges in the unrestrained condition, (b) an outer portion extending from the flanges a distance sufficient to permit limited lateral deformation of the outer portion to accommodate contours of the wearer's face.

8. Swim goggles as claimed in claim 6 in which:

(a) the seal gasket has an inner portion having a width greater than the width between adjacent flange tip in the unrestrained condition, so that the seal gasket is gripped by the flange tips.

9. Swim goggles as claimed in claim 1 in which:

(a) in the unrestrained condition, the flanges are curved inwardly towards each other so as to grip the seal gasket therebetween, at a location on the seal gasket intermediate of inner and outer faces of the seal gasket intermediate of inner and outer faces of the seal gasket.

10. Swim goggles as claimed in claim 1 in which:
(a) the seal holder has a Shore A Durometer hardness within a range of 35 to 95,
(b) the seal gasket has a Shore hardness within a range of Shore 00 Durometer 10–50 to Shore A 7–20.

11. A seal assembly adapted to seal a lens to a wearer's face, comprising:
(a) a peripheral frame being made of a first material and adapted to enclose a lens therein,
(b) a seal holder having means for securing the seal holder to the frame, the seal holder being made of a second material and having a pair of spaced flanges extending in a direction generally away from the lens eyepiece, space between the flanges providing a groove extending around the lens,
(c) a seal gasket adapted to be fitted within the groove between the flanges, the seal gasket being made of a third material and having an outer face standing clear of the flanges and being adapted to contact the wearer's face,
(d) the seal holder being resiliently deformable under normal wearing forces when compared with the rigid frame, but sufficiently stiff to compress and retain the seal gasket within the groove, the seal gasket being resiliently deformable and softer than the seal holder, and the seal holder being more resilient than the peripheral frame so that stiffness of the second material relative to the third material, and the stiffness of the first material relative to the second material increases continually outwardly in a successive fashion in a direction away from the wearer's face to provide a secure but comfortable seal with the wearer's face.

12. A seal assembly as claimed in claim 11 in which:
(a) the seal holder has an inner portion cooperating with the frame, an outer portion having the two flanges, and an intermediate portion disposed between the inner and outer portions thereof,
(b) the flanges having flange roots adjacent the intermediate portion, and flange tips at outer extremities of the flanges, width between the flange tips being less than width between the flange roots in the unrestrained condition, so as to provide a groove with a re-entrant cross-section to grip the flange gasket.

13. A seal assembly as claimed in claim 12 in which:
(a) the seal gasket has an inner portion having a width greater than the width between adjacent flange tips in the unrestrained condition, so that the seal gasket is gripped by the flange tips.

14. A seal assembly as claimed in claim 11 in which the seal gasket has:
(a) an inner portion having a width slightly greater than width of the groove between the flanges of the seal holder in the unrestrained condition,
(b) an outer portion extending from the flanges a distance sufficient to permit limited lateral deformation of the outer portion to accommodate contours of the wearer's face.

15. A seal assembly as claimed in claim 11 in which:
(a) in the unrestrained condition, the flanges of the seal holder are curved inwardly towards each other so as to grip the seal gasket therebetween at a location on the seal gasket intermediate of inner and outer faces of the seal gasket.

16. A face mask, comprising:
(a) a lens eyepiece and a peripheral frame made of a first material surrounding the lens,
(b) a head strap interconnecting opposite sides of the mask,
(c) a seal assembly cooperating with the frame, the seal assembly including a seal holder and a seal gasket being made of a second material and a third material, respectively, the seal holder being secured to the frame and having a pair of spaced flanges extending in a direction generally away from the lens, space between the flanges providing a groove extending around the eyepiece, the seal gasket being fitted within the groove between the flanges and having an outer face standing clear of the flanges and being adapted to contact the wearer's face, the seal holder being resiliently deformable under normal wearing forces when compared with the rigid frame, but sufficiently stiff to compress and retain the seal gasket within the groove, the seal gasket being resiliently deformable and softer than the seal holder, and the seal holder being more resilient than the peripheral frame so that stiffness of the second material relative to the third material, and the stiffness of the first material relative to the second material increases continually outwardly in a successive fashion in a direction away from the wearer's face to provide a secure but comfortable seal with the wearer's face.

17. A face mask as claimed in claim 16 in which:
(a) the seal holder has an inner portion cooperating with the frame, an outer portion having the two flanges, and an intermediate portion disposed between the inner and outer portions thereof,
(b) the flanges having flange roots adjacent the intermediate portion, and flange tips at outer extremities of the flanges, width between the flange tips being less than width between the flange roots in the unrestrained condition, so as to provide a groove with a re-entrant cross-section to grip the flange gasket.

18. A face mask as claimed in claim 16 in which:
(a) in the unrestrained condition, the flanges of the seal holder are curved inwardly towards each other so as to grip the seal gasket therebetween at a location in the seal gasket intermediate of inner and outer faces of the seal gasket.

19. A face mask as claimed in claim 16 in which:
(a) an inner portion having a width slightly greater than width of the groove between the flanges of the seal holder in the unrestrained condition,
(b) an outer portion extending from the flanges a distance sufficient to permit limited lateral deformation of the outer portion to accommodate contours of the wearer's face.

20. A face mask as claimed in claim 19 in which:
(a) the seal gasket has an inner portion having a width greater than the width between adjacent flange tips in the unrestrained condition, so that the seal gasket is gripped by the flange tips.

* * * * *